US009625843B2

(12) United States Patent
Shirai et al.

(10) Patent No.: US 9,625,843 B2
(45) Date of Patent: Apr. 18, 2017

(54) ELECTROSTATIC IMAGE DEVELOPING TONER

(71) Applicant: Konica Minolta, Inc., Tokyo (JP)

(72) Inventors: Aya Shirai, Hino (JP); Tatsuya Nagase, Tachikawa (JP); Junya Onishi, Hachioji (JP); Tatsuya Fujisaki, Hino (JP); Naoya Tonegawa, Sagamihara (JP); Junichi Furukawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/883,167

(22) Filed: Oct. 14, 2015

(65) Prior Publication Data

US 2016/0109818 A1 Apr. 21, 2016

(30) Foreign Application Priority Data

Oct. 20, 2014 (JP) ..... 2014-213488

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/0821* (2013.01); *G03G 9/08791* (2013.01); *G03G 9/08795* (2013.01); *G03G 9/08797* (2013.01); *G03G 9/093* (2013.01); *G03G 9/09335* (2013.01)

(58) Field of Classification Search
CPC ..... G03G 9/09357; G03G 9/08755; G03G 9/08788
See application file for complete search history.

(56) References Cited

U.S. PATENT DOCUMENTS

2009/0068578 A1* 3/2009 Murakami ..... G03G 9/0808 430/105
2010/0297546 A1* 11/2010 Zhou ..... G03G 9/0819 430/108.23

FOREIGN PATENT DOCUMENTS

JP 200733773 A 2/2007
JP 4729950 B2 4/2011
JP 4742936 B2 5/2011

OTHER PUBLICATIONS

Decision of Refusal dated Dec. 13, 2016 from the corresponding Japanese Application No. JP 2014-213488; English translation of Decision of Refusal ; Applicant: Konica Minolta, Inc.; Total of 6 pages.
Notification of Reasons for Refusal dated Sep. 20, 2016 from corresponding Japanese Application; Patent Application No. 2014-213488; English translation of Notification of Reasons for Refusal; Total of 7 pages.

* cited by examiner

*Primary Examiner* — Peter Vajda
(74) *Attorney, Agent, or Firm* — Lucas & Mercanti, LLP

(57) ABSTRACT

An electrostatic image developing toner includes toner particles that contain coloring particles containing a binder resin, a coloring agent and a releasing agent. The binder resin includes an amorphous resin and a crystalline polyester resin. The toner satisfies Relations (1) and (2). ΔH1 is the amount of heat absorption based on a melting peak of the crystalline polyester resin in a first heating step. ΔH2 is the amount of heat absorption based on a melting peak of the crystalline polyester resin in a second heating step. ΔH0 is the value of the amount of heat absorption based on a melting peak of the crystalline polyester resin in the second heating step, multiplied by the ratio of the crystalline polyester introduced in the electrostatic image developing toner.

$0.43<\Delta H1/\Delta H0<0.95$ Relation (1):

$0.45<\Delta H2/\Delta H1<1.20$ Relation (2):

7 Claims, No Drawings

ELECTROSTATIC IMAGE DEVELOPING TONER

CROSS REFERENCE TO RELATED APPLICATION

This Application claims the priority of Japanese Patent Application No. 2014-213488 filed on Oct. 20, 2014, which is incorporated by reference herein.

BACKGROUND OF THE INVENTION

1. Field of the Invention

The present invention relates to an electrostatic image developing toner used for electrophotographic image forming.

2. Description of Related Art

It has been required that electrostatic image developing toners used for electrophotographic image forming (hereinafter also simply referred to as "toners") can be fixed with decreased heat energy in order to increase the printing speed and to reduce the energy consumption of image forming apparatuses. For this reason, further improved low-temperature fixability has been required for toners. For example, in one of such toners known in the art, a crystalline polyester resin having a sharp-melting property is introduced to the toner as a binding resin so as to decrease the glass transition point or the melt viscosity of the binder resin.

Specifically, for example, it is known to use a binder resin that is a mixture of an amorphous resin and a crystalline polyester resin having high miscibility with the amorphous resin. Such combined use of a crystalline polyester resin can improve the low-temperature fixability since the crystalline polyester resin serves as a plasticizer in heat fixing (e.g. see JP 4729950B).

However, a problem with such toners is poor heat-resistant storage stability, which is due to plasticization of toner particles caused by mutual dissolution between the amorphous resin and the crystalline polyester resin.

To cope with the poor heat-resistant storage stability, JP 4729950B discloses a method for reducing the decrease in heat-resistant storage stability by adjusting the glass transition point of the toner.

Another method for improving the heat-resistant storage stability is to form a shell layer composed of a low-miscible amorphous resin having low miscibility with a crystalline polyester resin on a core particle composed of a high-miscible amorphous resin and the crystalline polyester resin (e.g. see JP 4742936B).

However, such toners may lack in image fixing strength since the binder resin is less fusible in heat fixing due to the high glass transition point of its amorphous resin, and the shell layer, which is formed on the surface of each toner particle, is not plasticized but remains stiff in heat fixing. Therefore, a fixed image may be lack in fixing strength. As a result, these toners cannot be a perfect solution for poor heat-resistant storage stability.

SUMMARY OF THE INVENTION

The present invention was made in view of the above-described circumstances, and an object thereof is to provide an electrostatic image developing toner with both of adequate low-temperature fixability and adequate heat-resistant storage stability.

In order to realize the above object, according to a first aspect of the present invention, there is provided an electrostatic image developing toner including toner particles that contain coloring particles containing a binder resin, a coloring agent and a releasing agent, wherein the binder resin includes an amorphous resin and a crystalline polyester resin, and wherein the electrostatic image developing toner satisfies the following Relation (1) and Relation (2), $$0.43<\Delta H1/\Delta H0<0.95 \quad \text{Relation (1):}$$

$$0.45<\Delta H2/\Delta H1<1.20 \quad \text{Relation (2):}$$

where ΔH1 (J/g) is the amount of heat absorption based on a melting peak of the crystalline polyester resin in a first heating step from room temperature to 150° C., determined on a DSC curve of the electrostatic image developing toner measured by a differential scanning calorimetry, ΔH2 (J/g) is the amount of heat absorption based on a melting peak of the crystalline polyester resin in a second heating step from 0° C. to 150° C., determined on the DSC curve of the toner, and ΔH0 (J/g) is the value of the amount of heat absorption based on a melting peak of the crystalline polyester resin in the second heating step from 0° C. to 150° C., determined on a DSC curve of the crystalline polyester measured by a differential scanning calorimetry, multiplied by the ratio of the crystalline polyester introduced in the electrostatic image developing toner.

Preferably, the electrostatic image developing toner satisfies the following Relation (3) and Relation (4).

$$0.48<\Delta H1/\Delta H0<0.90 \quad \text{Relation (3):}$$

$$0.50<\Delta H2/\Delta H1<0.95 \quad \text{Relation (4):}$$

Preferably, the crystalline polyester resin satisfies the following Relation (5) and Relation (6), where $C_{alcohol}$ is the number of carbons of a main chain of a structural unit derived from a polyhydric alcohol for producing the crystalline polyester resin, and $C_{acid}$ is the number of carbons of a main chain of a structural unit derived from a polycarboxylic acid for producing the crystalline polyester resin.

$$C_{acid}\geq 4 \quad \text{Relation (5):}$$

$$C_{alcohol}\leq 14 \quad \text{Relation (6):}$$

Preferably, the crystalline polyester resin satisfies the following Relation (7) and Relation (8).

$$C_{acid}\geq 10 \quad \text{Relation (7):}$$

$$6\leq C_{alcohol}\leq 12 \quad \text{Relation (8):}$$

Preferably, the crystalline polyester resin has a melting point of 65° C. to 85° C.

Preferably, the crystalline polyester resin has a melting point of 70° C. to 85° C.

Preferably, the electrostatic image developing toner satisfies the following Relation (9) and Relation (10).

$$0.55\leq\Delta H1/\Delta H0\leq 0.85 \quad \text{Relation (9):}$$

$$0.55\leq\Delta H2/\Delta H1<0.80 \quad \text{Relation (10):}$$

Preferably, the toner particles has a core-shell structure in which a shell layer is provided on a surface of the coloring particles.

Preferably, the amorphous resin is a vinyl resin.

DETAILED DESCRIPTION OF THE PREFERRED EMBODIMENT

Hereinafter, the present invention will be described specifically. Though various technical limitations which are preferable to perform the present invention are included in the after-mentioned embodiment, the scope of the invention is not limited to the following embodiment and the illustrated examples.

The toner of the present invention includes toner particles that include coloring particles containing a binder resin, a coloring agent and a releasing agent. The binder resin includes an amorphous resin and a crystalline polyester resin.

Further, the toner satisfies the following Relation (1) and Relation (2), where ΔH1 (J/g) is the amount of heat absorption based on a melting peak of the crystalline polyester resin in the first heating step from room temperature to 150° C., determined on a DSC curve of the toner measured by a differential scanning calorimetry, ΔH2 (J/g) is the amount of heat absorption based on a melting peak of the crystalline polyester resin in the second heating step from 0° C. to 150° C., determined on the DSC curve of the toner, ΔH0 (J/g) is the value of the amount of heat absorption based on a melting peak of the crystalline polyester resin in the second heating step of 0° C. to 150° C., determined on a DSC curve of the crystalline polyester resin measured by a differential scanning calorimetry, multiplied by the ratio of the crystalline polyester introduced in the electrostatic image developing toner.

$$0.43<\Delta H1/\Delta H0<0.95 \quad \text{Relation (1):}$$

$$0.45<\Delta H2/\Delta H1<1.20 \quad \text{Relation (2):}$$

The value of ΔH1/ΔH0 in Relation (1) is more preferably 0.48<ΔH1/ΔH0<0.90, yet more preferably 0.55≤ΔH1/ΔH0≤0.85.

The value of ΔH2/ΔH1 in Relation (2) is more preferably 0.50<ΔH2/ΔH1<0.95, yet more preferably 0.55≤ΔH2/ΔH1<0.80.

The differential scanning calorimetry of the toner is conducted by using a "Diamond DSC" (PerkinElmer Inc.) in the measuring condition (heating and cooling conditions) in which a sample undergoes the first heating step of raising the temperature from room temperature to 150° C. at a heating rate of 10° C./min and holding the temperature at 150° C. for 5 minutes, a cooling step of decreasing the temperature from 150° C. to 0° C. at a cooling rate of 10° C./min and holding the temperature at 0° C. for 5 minutes, and the second heating step of raising the temperature from 0° C. to 150° C. at a heating rate of 10° C./min in the written order. Regarding the measuring process, 3.0 mg of the toner is sealed in an aluminum pan and is placed in a sample holder of the "Diamond DSC". An empty aluminum pan is used for a reference.

Since the toner of the present invention contains the crystalline polyester resin, the DSC curve of the toner measured by differential scanning calorimetry has an endothermic peak (melting peak) derived from the crystalline polyester resin.

The miscible state of the crystalline polyester resin in the toner particles is determined from the amount of heat absorption based on the melting peak of the crystalline polyester resin on the DSC curves of the crystalline polyester resin and the toner of the present invention measured by differential scanning calorimetry.

First, ΔH0 (J/g), which is the value of the amount of heat absorption based on the melting peak of the crystalline polyester in the second heating step, determined on the DSC curve of the crystalline polyester resin measured by differential scanning calorimetry, multiplied by the ratio of the crystalline polyester resin introduced in the toner, is considered to represent a state in which the crystalline polyester resin is not dissolved to the other toner components such as the amorphous resin at all in the toner particles and is all present as a crystal domain.

Further, ΔH1 (J/g), which is the amount of heat absorption based on the melting peak in the first heating step determined on the DSC curve of the toner measured by differential scanning calorimetry, is considered to correspond to the amount of crystalline polyester resin that is present as a crystal domain in the toner particles.

Accordingly, ΔH1/ΔH0 in Relation (1), which is the ratio of ΔH1 to ΔH0, represents the ratio of crystalline polyester resin not being dissolved in the other toner components but being present as a crystal domain in the toner particles. That is, a smaller ΔH1/ΔH0 means that the crystalline polyester resin is dissolved at a higher rate in the toner particles.

In the differential scanning calorimetry, the toner is heated up to 150° C. in the first heating step. Accordingly, this step can be assumed as a heat fixing step of the toner. Then, ΔH2 (J/g), which is the amount of heat absorption based on the melting peak in the second heating step, is considered to correspond to the amount of crystalline polyester resin that is not dissolved in the other toner components but remains as a crystal domain in a fixed image after heat fixing.

Accordingly, ΔH2/ΔH1 in Relation (2), which is the ratio of ΔH2 to ΔH1, represents a change of the crystallinity of the crystalline polyester resin between before and after a heat fixing step. That is, a smaller ΔH2/ΔH1 means that dissolution of the crystalline polyester resin progresses in a heat fixing step.

In the above-described DSC curve measured by differential scanning calorimetry, when the melting peak of ΔH1 overlaps with a peak of another toner component and appears as an overlapped peak having two or more peak tops, the amount of heat absorption ΔH (J/g) from the start to the end of the overlapped peak with respect to the base line is determined. Further, the fractional area ratio S1(%) of the melting peak derived from the crystalline polyester resin with respect to the peak area of the overlapped peak is also determined. Then, ΔH1 (J/g) is calculated as ΔH (J/g)×S1 (%). The fractional area ratio S1 of the melting peak derived from the crystalline polyester resin in the overlapped peak is determined by dividing the peak area by a perpendicular from a minimum point between the peak tops to the temperature axis, determining a peak having a peak top temperature closest to the melting point of the crystalline polyester resin among the peak tops of the overlapped peak as the melting peak derived from the crystalline polyester resin, and calculating the fractional area ratio thereof.

The same applies to ΔH2 when its melting peak has two or more peak tops.

The differential scanning calorimetry of the crystalline polyester resin is conducted similarly as described above in which crystalline polyester resin that is isolated and extracted from the toner is used as a sample. To isolate and extract the crystalline polyester resin from the toner, for example, a method described in JP 3869968B may be employed.

The value of ΔH0 is determined by multiplying the amount of heat absorption (ΔHx) based on the melting peak in the second heating step on the DSC curve of the crystalline polyester resin measured by differential scanning calorimetry by the mass ratio of the crystalline polyester resin in the toner particles.

The mass ratio of the crystalline polyester resin in the toner particles can be measured, for example, by gas chromatography mass spectrometry or NMR spectrometry.

The value of ΔH0 is preferably from 5 J/g to 30 J/g.

The value of ΔH1/ΔH0 can be controlled by changing the composition of a polycarboxylic acid and a polyhydric alcohol for producing the crystalline polyester resin, the composition of the amorphous resin, the temperature during the production of the toner, and the like.

The value of ΔH2/ΔH1 can be controlled by changing the composition of a polycarboxylic acid and a polyhydric alcohol for producing the crystalline polyester resin, the composition of the amorphous resin, and the like.

Binder Resin

The binder resin of the toner particles according to the present invention includes the amorphous resin and the crystalline polyester resin.

The crystalline polyester resin may also be a styrene acrylate-modified polyester resin in which a styrene acrylate polymer segment and a crystalline polyester polymer segment are bound together.

Crystalline Polyester Resin

A crystalline polyester resin refers to a polyester resin that does not exhibit a stepwise change in the amount of heat absorption but a clear melting peak in differential scanning calorimetry (DSC) among polyester resins known in the art that are produced by a polycondensation reaction of a di- or more carboxylic acid (polycarboxylic acid) and a di- or more hydric alcohol (polyhydric alcohol). Specifically, a clear melting peak means a melting peak with a half width of 15° C. or less in the second heating step in the DSC curve of the crystalline polyester resin measured by the above-described differential scanning calorimetry.

Melting Point of Crystalline Polyester Resin

The melting point of the crystalline polyester resin is preferably from 65° C. to 85° C., more preferably from 75° C. to 85° C.

When the crystalline polyester resin has a melting point within the above-described range, adequate low-temperature fixability and good image storage stability can be achieved.

The melting point of the crystalline polyester resin can be adjusted by changing the resin composition.

The melting point of the crystalline polyester resin corresponds to the peak top temperature of the melting peak in the second heating step in the DSC curve of the crystalline polyester resin measured by the above-described differential scanning calorimetry. When there are a plurality of melting peaks in the DSC curve, the peak top temperature of a melting peak having the largest amount of heat absorption is determined as the melting point.

The polycarboxylic acid for producing the crystalline polyester resin is a compound having two or more carboxyl groups in a molecule.

Specifically, such compounds include, for example, saturated aliphatic dicarboxylic acids such as succinic acid, sebacic acid and dodecanedioic acid; alicyclic dicarboxylic acids such as cyclohexane dicarboxylic acid; aromatic dicarboxylic acids such as phthalic acid, isophthalic acid and terephthalic acid; tri- or more carboxylic acids such as trimellitic acid and pyromellitic acid; anhydrides of these carboxylic acids or esters of these carboxylic acids with an alkyl of 1 to 3 carbons; and the like. An aliphatic dicarboxylic acid is preferably used as the polycarboxylic acid for producing the crystalline polyester resin.

These compounds may be used alone or in combination of two or more.

The polyhydric alcohol for producing the crystalline polyester resin is a compound having two or more hydroxyl groups in a molecule.

Specifically, such compounds include, for example, aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; tri- or more hydric alcohols such as glycerin, pentaerythritol, trimethylol propane and sorbitol. An aliphatic diol is preferably used as the polyhydric alcohol for producing the crystalline polyester resin.

These compounds may be used alone or in combination of two or more.

When the crystalline polyester resin is produced from an aliphatic polycarboxylic acid as the polycarboxylic acid and an aliphatic polyhydric alcohol as the polyhydric alcohol, a preferred crystalline polyester resin is produced from a combination of a polycarboxylic acid and a polyhydric alcohol that satisfies both Relation (5) and Relation (6) (hereinafter referred to as a "crystalline polyester resin from carbon number-specified materials"), where $C_{alcohol}$ is the number of carbons of the main chain of the structural unit derived from the polyhydric alcohol for producing the crystalline polyester resin, and $C_{acid}$ is the number of carbons of the main chain of the structural unit derived from the polycarboxylic acid for producing the crystalline polyester resin. A particularly preferred crystalline polyester resin is produced from a combination of a polycarboxylic acid and a polyhydric alcohol that satisfies both Relation (7) and Relation (8).

$$C_{acid} \geq 4 \quad \text{Relation (5):}$$

$$C_{alcohol} \leq 14 \quad \text{Relation (6):}$$

$$C_{acid} \geq 10 \quad \text{Relation (7):}$$

$$6 \leq C_{alcohol} \leq 12 \quad \text{Relation (8):}$$

When two or more types of polycarboxylic acids are contained as the polycarboxylic acid for producing the crystalline polyester resin, it is preferred that $C_{acid}$ satisfies the above Relation (5) to Relation (8) with regard to a polycarboxylic acid contained at the highest ratio (mass %). Similarly, when two or more types of polyhydric alcohols are contained as the polyhydric alcohol for producing the crystalline polyester resin, it is preferred that $C_{alcohol}$ satisfies the above Relation (5) to Relation (8) with regard to a polyhydric alcohol contained at the highest ratio (mass %).

Preferred combinations of a polycarboxylic acid and a polyhydric alcohol for producing the crystalline polyester resin of the present invention that satisfy Relation (5) and Relation (6) include 1,10-decanediol (10 carbons) with sebacic acid (10 carbons), 1,10-decanediol (10 carbons) with dodecanedioic acid (12 carbons), 1,6-hexanediol (6 carbons) with dodecanedioic acid (12 carbons), and the like.

Such crystalline polyester resins from carbon number-specified materials have low polarity of the crystalline polyester resin since the main chain of the polyhydric alcohol is long. Accordingly, when the amorphous resin of the binder resin is a styrene acrylate resin or a polyester resin, it is possible to keep the value of $\Delta H1/\Delta H0$ in a high range as well as to keep the value of $\Delta H2/\Delta H1$ in a suitable range. Therefore, good low-temperature fixability and good heat-resistant storage stability can be achieved.

It is preferred that 80 mass % or more of the crystalline polyester resin of the binder resin is a crystalline polyester resin from carbon number-specified materials. It is particularly preferred that all of the crystalline polyester resin in the binder resin is a crystalline polyester resin from carbon number-specified materials.

The crystalline polyester resin may be produced by any method including a general polymerization method of polyester in which the above-described polycarboxylic acid and polyhydric alcohol are reacted in the presence of a catalyst. For example, it is preferred that a direct polycondensation method or a transesterification method is suitably selected according to the type of the monomers.

Examples of catalysts that can be used for producing the crystalline polyester resin include, for example, titanium catalysts such as titanium tetraethoxide, titanium tetrapropoxide, titanium tetraisopropoxide and titanium tetrabutoxide, tin catalysts such as dibutyltin dichloride, dibutyltin oxide and diphenyltin oxide, and the like.

Regarding the ratio of the polycarboxylic acid and the polyhydric alcohol, it is preferred that the stoichiometric ratio of the hydroxyl groups (OH) of the polyhydric alcohol to the carboxyl groups (COOH) of the polycarboxylic acid is from 1.5/1 to 1/1.5, more preferably from 1.2/1 to 1/1.2.

Molecular Weight of Crystalline Polyester Resin

It is preferred that the crystalline polyester resin has a weight average molecular weight (Mw) of 5000 to 50000 and a number average molecular weight (Mn) of 1500 to 25000, which are calculated from the molecular weight distribution measured by gel permeation chromatography (GPC).

The molecular weight is measured by GPC as follows. A device "HLC-8220" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 ml/min as carrier solvent. The sample (crystalline polyester resin) is dissolved in tetrahydrofuran to a concentration of 1 mg/ml by a treatment with an ultrasonic disperser at room temperature for 5 minutes. The solution is then treated with a membrane filter having a pore size of 0.2 μm to obtain a sample solution. An aliquot (10 μl) of the sample solution is injected into the device along with the carrier solvent and is detected by means of a refractive index (RI) detector. The molecular weight distribution of the sample is calculated by using a calibration curve, which is determined by using standard monodisperse polystyrene particles. Polystyrenes respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (Pressure Chemical Company) are used as the standard polystyrene samples used for determining the calibration curve. At least ten different standard polystyrene samples are measured to determine the calibration curve. A refractive index detector is used as the detector.

The content of the crystalline polyester resin in the binder resin is preferably from 5 to 30 mass %.

When the content of the crystalline polyester resin in the binder resin is equal to or greater than 5 mass %, adequate low-temperature fixability can be certainly achieved. When the content of the crystalline polyester resin in the binder resin is equal to or less than 30 mass %, the crystalline polyester resin can be certainly introduced to the toner particles in the production of the toner.

Amorphous Resin

An amorphous resin refers to a resin that does not exhibit any clear endothermic peak in differential scanning calorimetry (DSC).

The amorphous resin may be a polyester resin, a vinyl resin such as a styrene acrylate resin, or the like. It is preferred that a styrene acrylate resin as the amorphous resin has a structural unit derived from an acid monomer such as acrylic acid and methacrylic acid.

It is preferred that the amorphous resin has a number average molecular weight (Mn) of 1500 to 25000 and a weight average molecular weight (Mw) of 10000 to 80000, which are measured by gel permeation chromatography (GPC).

When the molecular weight of the amorphous resin is within the above-described range, both of adequate low-temperature fixability and good heat-resistant storage stability can be achieved more certainly.

The molecular weight of the amorphous resin is measured by GPC in the same manner as above except that the sample is the amorphous resin.

It is preferred that the amorphous resin has a glass transition point of 40° C. to 70° C., more preferably 50° C. to 60° C.

When the glass transition point of the amorphous resin is equal to or greater than 40° C., the toner can have a sufficient thermal strength, and the adequate heat-resistant storage stability can therefore be achieved. When the glass transition point of the amorphous resin is equal to or less than 70° C., the adequate low-temperature fixability can be achieved more certainly.

The glass transition point of the amorphous resin is measured as follows. The above-described differential scanning calorimetry is conducted for the amorphous resin to obtain the DSC curve. The data on the second heating step thereof is analyzed, and the intersection of the extended base line of the curve in the part before the rise of the first endothermic peak with the steepest tangent of the curve in the part from the rise to the peak top of the first peak is determined as the glass transition point.

In the toner of the present invention, it is preferred that the toner particles have a core-shell structure in which the surface of core coloring particles containing the binder resin, the coloring agent and the releasing agent are covered with a shell layer.

The shell layer may not completely cover the core particles, but the surface of the core particles may be partly exposed.

By the core-shell structure of the toner particles, good heat-resistant storage stability can be achieved more certainly.

The shell layer may be made of any resin, and amorphous polyester resin and vinyl resins are preferred.

Coloring Agent

For the coloring agent, various coloring agents known in the art such as carbon black, black iron oxide, dyes and pigments may be used.

Examples of such carbon black include, for example, channel black, furnace black, acetylene black, thermal black, lamp black and the like. Examples of such black iron oxide include, for example, magnetite, hematite, iron titanium trioxide and the like.

Examples of such dyes include, for example, C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, C. I. Solvent Blue 95 and the like.

Examples of such pigments include, for example, C. I. Pigment Red 5, C. I. Pigment Red 48:1, C. I. Pigment Red 48:3, C. I. Pigment Red 53:1, C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 150, C. I. Pigment Red 166, C. I. Pigment Red 177, C. I. Pigment Red 178, C. I. Pigment Red 222, C. I. Pigment Red 238, C. I. Pigment Red 269, C. I. Pigment Orange 31, C. I. Pigment Orange 43, C. I. Pigment Yellow 14, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 156, C. I. Pigment Yellow 158, C. I. Pigment Yellow 180, C. I. Pigment Yellow 185, C. I. Pigment Green 7, C. I. Pigment Blue 15:3, C. I. Pigment Blue 60 and the like.

These coloring agents may be used alone or in combination of two or more for producing the respective color toners.

The content of the coloring agent in the toner particles is preferably from 1 mass % to 10 mass %, more preferably from 2 mass % to 8 mass %.

Releasing Agent

For the releasing agent, a variety of waxes known in the art may be used.

Waxes that can be suitably used include polyolefin waxes such as low-molecular weight polypropylene, polyethylene, oxidized polypropylene and polyethylene, ester waxes such as behenyl behenate, and the like.

To be more specific, examples of such waxes include, for example, polyolefin waxes such as a polyethylene wax and a polypropylene wax; branched chain hydrocarbon waxes such as a microcrystalline wax; long chain hydrocarbon waxes such as a paraffin wax and SASOLWAX, dialkylketone waxes such as distearylketone, ester waxes such as carnauba wax, montan wax, behenyl behenate, trimethylolpropane tribehenate, pentaerythritol tetrabehenate, pentaerythritol diacetate behenate, glycerin tribehenate, 1, 18-octadecanediol distearate, tristearyl trimellitate and distearyl maleate; amide waxes such as ethylenediamine behenylamide and trimellitic tristearylamide, and the like.

It is preferred that the releasing agent does not cause an interaction such as mutual dissolution with the crystalline polyester resin of the binder resin.

Among the above-described compounds, those having a low melting point, specifically having a melting point of 60° C. to 100° C. are preferably used in terms of the releasing property in low-temperature fixing. Further, it is preferred that the releasing agent has a melting point of approximately (Mp1−10)° C. to (Mp1+20)° C., where Mp1 is the melting point of the crystalline polyester resin of the binder resin.

The content of the releasing agent in the toner particles is preferably from 1 to 20 mass %, more preferably from 5 to 20 mass %. When the content of the releasing agent in the toner particles is within the above-described range, both of releasing property and fixability are achieved more certainly.

To introduce the releasing agent to the toner particles, an example method is to aggregate and fuse the releasing agent fine particles along with the amorphous resin fine particles and the crystalline polyester resin fine particles in an aqueous medium in the aggregating and fusing step of the method for producing the toner described below. Fine particles of the releasing agent can be obtained as a dispersion in which the releasing agent is dispersed in an aqueous medium. Such a dispersion of the releasing agent fine particles can be prepared by heating an aqueous medium containing a surfactant at a temperature higher than the melting point of the releasing agent, adding a melted releasing agent solution, applying a mechanical energy such as mechanical stirring or an ultrasonic energy to finely disperse the releasing agent, and thereafter cooling the dispersion.

When the amorphous resin is a styrene acrylate resin or the like, the releasing agent may be introduced to the toner particles by blending the releasing agent with the amorphous resin fine particles (styrene acrylate resin fine particles) before they are subjected to the aggregating and fusing step. Specifically, such an amorphous resin fine particle dispersion containing the releasing agent can be prepared by so-called mini-emulsion polymerization that involves dissolving the releasing agent in a solution of a polymerizable monomer for producing a styrene-acrylate resin, adding the solution to an aqueous medium containing a surfactant, applying a mechanical energy such as mechanical stirring or an ultrasonic energy to finely disperse the solution as described above, and thereafter adding a polymerization initiator to cause polymerization at a desired polymerization temperature.

Components of Toner Particles

The toner particles according to the present invention may contain an internal additive such as a charge controlling agent according to need in addition to the binder resin, the coloring agent and the releasing agent.

Charge Controlling Agent

For the charge controlling agent, a variety of compounds known in the art can be used.

The content of the charge controlling agent in the toner particles is preferably from 0.1 to 10 mass %, more preferably from 1 to 5 mass %.

Average Particle Size of Toner

It is preferred that the toner of the present invention has an average particle size of, for example, 3 μm to 8 μm, more preferably 5 μm to 8 μm in volume median size. When the toner is produced by an emulsion aggregation method described below for example, the average particle size can be controlled by changing the concentration of a coagulant used, the amount of organic solvent added, fusing time, polymer composition and the like.

When the volume median particle size is within the above-described range, the transferring efficiency is increased. Therefore, the halftone image quality is improved. Further, the image quality of thin lines and dots is improved.

The volume median particle size of the toner is measured and calculated by using a measuring equipment composed of a "MULTISIZER 3" (Beckman Coulter Inc.) and a computer system installed with a data processing software "Software V3.51" connected thereto. Specifically, 0.02 g of a sample (toner) is added to 20 mL of a surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion for 1 minute. The toner dispersion thus prepared is added to "ISOTON II" (Beckman Coulter Inc.) in a beaker placed in sample stand by a pitette until the concentration displayed on the measuring equipment reaches 8%. Within this concentration range, reproducible measurement values can be obtained. The measuring particle count and the aperture size of the measuring equipment are set to 25000 and 100 μm respectively. The measuring range, which is from 2 μm to μm, is divided into 256 sections to calculate the respective frequencies. The particle size where the accumulated volume counted from the largest size reaches 50% is determined as the volume median particle size.

Average Circularity of Toner

In the toner of the present invention, it is preferred that the toner particles of the toner have an average circularity of 0.930 to 1.000, more preferably 0.950 to 0.995 in terms of the stability of the charging characteristics and the low-temperature fixability.

When the average circularity is within the above-described range, the individual toner particles are less crushable. This prevents the triboelectric charge applying member from smudges and stabilizes the charging characteristics of the toners. Further, high quality images can be formed.

In the present invention, the average circularity of the toner particles is measured by an "FPIA-2100" (Sysmex Corp.).

Specifically, a sample (toner particles) is mixed with an aqueous solution containing a surfactant and is further dispersed by ultrasonication for 1 minute. Thereafter, photographs are taken by means of the "FPIA-2100" (Sysmex Corp.) in the conditions of the HPF (high power imaging) mode at an adequate concentration corresponding to an HPF detect number of 3000 to 10000. The average circularity of the toner is calculated by determining the circularity of each toner particle according to the following Equation (T) and dividing the sum of the circularities of the individual toners by the total number of toner particles.

Circularity=(Circumference of circle having same area as projected image of particle)/(Perimeter of projected image of particle) Equation (T):

Softening Point of Toner

It is preferred that the toner has a softening point of 80° C. to 120° C., more preferably 90° C. to 110° C. in terms of imparting the low-temperature fixability to the toner.

The softening point of the toner is measured by the following flow tester.

Specifically, 1.1 g of a sample (toner) is placed and flattened in a petri dish in the environment of 20° C. and 50% RH. After at least 12 hours, the sample was pressed at a pressure of 3820 kg/cm$^2$ for 30 seconds by means of a shaping machine "SSP-10A" (Shimadzu Corp.) to form a cylindrically shaped sample with a diameter of 1 cm. Then, after preheating is complete, the shaped sample is pushed out from a hole (1 mm in diameter×1 mm) of a cylindrer die by using a flow tester "CFT-500D" (Shimadzu Corp.) with a 1 cm-diameter piston in the conditions of a load of 196 N (20 kgf), an initial temperature of 60° C., a preheating time of 300 seconds, a heating rate of 6° C./minute in the environment of 24° C. and 50% RH. The offset temperature $T_{offset}$ at an offset value of 5 mm is measured by a melting temperature measuring method (elevated temperature method), and the measured value is determined as the softening point.

External Additive

The above-described toner particles can be directly used as the toner. However, in order to improve the fluidity, charging characteristics, cleaning property and the like, an external additive such as a so-called fluidizer and a cleaning aid may be added to the toner particles.

A variety of compounds may be used in combination as the external additive.

Such external additives are added in a total amount of preferably 0.05 parts by mass to 5 parts by mass, more preferably 0.1 parts by mass to 3 parts by mass with respect to 100 parts by mass of the toner particles.

In the above-described toner, since the degree of mutual dissolution of the crystalline polyester resin with the amorphous resin in the toner particles and the degree of mutual dissolution of the crystalline polymer resin with the amorphous resin in a fixed image after heat fixing are respectively within the specific ranges, both of adequate low-temperature fixability and adequate heat-resistant storage stability are achieved.

This is probably due to the following reasons. When ΔH1/ΔH0 is within the above-described range, it means that large part of the crystalline polyester resin material is present as a crystal domain in the toner particles. That is, the crystal domain with a high melting point and a high hardness is present in the toner particles. Therefore, good heat-resistant storage stability is imparted to the toner particles.

Further, when the ΔH2/ΔH1 is within the above-described range, it means that large part of the crystal domain in the toner particles remains as the crystal domain in a fixed image after cooling. That is, when the heat energy applied in heat fixing raises the temperature to a value higher than the melting point of the crystalline polyester resin, the crystal domain present in the toner particles is melted to plasticize the surrounding binder resin such as the amorphous resin. Accordingly, the lower limit of the fixing temperature for achieving sufficient fixation can be decreased compared to a toner with a binder resin composed of only an amorphous resin.

When ΔH2/ΔH1 of Relation (2) is equal to or greater than 1.00, it means that that the amount of crystal domain in a fixed image is larger than the amount of crystal domain in the toner particles. This is probably because the part of the crystalline polyester resin that has been dissolved with the amorphous resin in the production of the toner particles and does not therefore constitute the crystal domain in the toner particles is partly recrystallized in the cooling after heat fixing to become the crystal domain in a fixed image.

Method for Producing Toner

It is preferred that the toner of the present invention is produced in an aqueous medium, i.e. by a wet method. For example, the toner can be produced by an emulsion aggregation method.

An emulsion aggregation method is a method for producing toner particles that involves mixing an aqueous dispersion of resin fine particles of a binder resin with an aqueous dispersion of fine particles of the other toner particle components according to need, allowing the fine particles to slowly aggregate and associate with each other while controlling the average particle size and the particle size distribution by keeping a balance between the repulsive force of the fine particle surface controlled by adjusting the pH and the cohesive force controlled by adding an electrolyte coagulant, and simultaneously with the association heating and stirring the dispersion to fuse of the fine particles to each other while controlling the shape.

A specific example of such methods for producing the toner involves the steps of:

(1) a coloring agent fine particle dispersion preparing step of dispersing the coloring agent in an aqueous medium to prepare a coloring agent fine particle dispersion;

(2) a crystalline polyester resin fine particle dispersion preparing step of dispersing the crystalline polyester resin in an aqueous medium to prepare a crystalline polyester resin fine particle dispersion;

(3) an amorphous resin fine particle dispersion preparing step of dispersing the amorphous resin containing other toner particle components such as a releasing agent and, if necessary, a charge controlling agent and the like in an aqueous medium to prepare an amorphous resin fine particle dispersion;

(4) an aggregating and fusing step of aggregating and fusing the amorphous resin fine particles, the crystalline polyester resin fine particles and the coloring agent fine particles in an aqueous medium to form aggregated particles;

(5) an aging step of aging the aggregated particles by heat energy to adjust the shape, so as to prepare a toner particle dispersion;

(6) a cooling step of cooling the toner particle dispersion;

(7) a filtering and washing step of separating out the toner particles from the cooled toner particle dispersion and removing the surfactant and the like from the surface of the toner particles; and (8) a drying step of drying the washed toner particles.

If necessary, the method further involves the step of:

(9) an external additive adding step of adding an external additive to the dried toner particles.

As used herein, the term "aqueous medium" refers to a medium that is composed of 50 mass % to 100 mass % of water and 0 mass % to 50 mass % of a water-soluble organic solvent. Examples of such water-soluble organic solvents include methanol, ethanol, isopropanol, butanol, acetone, methylethylketone, tetrahydrofuran and the like. Alcohol organic solvents that do not dissolve the produced resin are preferably used.

(1) Coloring Agent Fine Particle Dispersion Preparing Step

The coloring agent fine particle dispersion can be prepared by dispersing the coloring agent in an aqueous medium. It is preferred that the aqueous medium to which the coloring agent is dispersed contains a surfactant at a concentration equal to or greater than the critical micelle concentration (CMC) since the coloring agent can be uniformly dispersed. A variety of dispersers known in the art may be used for dispersing the coloring agent.

Surfactant

Examples of surfactants that can be used include anionic surfactants such as alkyl sulfates, polyoxyethylene (n)alkylether sulfates, alkylbenzene sulfonates, α-olefin sulfonates, phosphates and the like; cationic surfactants including amine salt surfactants such as alkyl amine salts, aminoalcohol fatty acid derivatives, polyamine fatty acid derivatives and imidazoline, and quaternary annmonium surfactants such as alkyltrimethylannmonium salts, dialkyldimethylannmonium salts, alkyldimethylbenzylannmonium salts, pyridinium salts, alkylisoquinolinium salts and benzethonium chloride; nonionic surfactants such as fatty acid amide derivatives and polyhydric alcohol derivatives; ampholytic surfactants such as alanine, dodecyl(aminoethyl)glycine, di(octylaminoethyl)glycine and N-alkyl-N,N-dimethylannmonium betaine; and the like. In addition, anionic surfactants and cationic surfactants having a fluoroalkyl group may also be used.

It is preferred that the dispersed coloring agent fine particles have a volume median particle size of 10 nm to 300 nm in the coloring agent fine particle dispersion prepared in the coloring agent fine particle dispersion preparing step.

The volume median particle size of the coloring agent fine particles in the coloring agent fine particle dispersion is measured by an electrophoretic light scattering spectrometer "ELS-800" (Otsuka Electronics, Co. Ltd.).

Alternatively, the coloring agent may be introduced to the toner particles in the amorphous resin fine particle dispersion preparing step described below by dissolving or dispersing them in a monomer solution for producing the amorphous resin beforehand by a mini-emulsion method.

(2) Crystalline Polyester Resin Fine Particle Dispersion Preparing Step

Examples of methods for dispersing the crystalline polyester resin in an aqueous medium include an aqueous direct dispersion method of dispersing the crystalline polyester resin in an aqueous medium containing a surfactant by means of ultrasonic dispersion or bead mill dispersion, a dissolution-emulsification-desolvation method of dissolving the crystalline polyester resin in a solvent, dispersing the solution in an aqueous medium to form emulsion particles (oil particles) and then removing the solvent, a phase-inversion emulsification method, and the like.

It is preferred that the crystalline polyester resin fine particles obtained in the crystalline polyester fine particle dispersion preparing step have an average particle size within the range of, for example, 50 nm to 500 nm in volume median size.

The volume median particle size is measured by using a "UPA-150" (Microtrac Corp.).

(3) Amorphous Resin Fine Particle Dispersion Preparing Step

When the amorphous resin is a styrene acrylate resin, the amorphous resin fine particle dispersion can be prepared by adding the resin to an aqueous medium containing a surfactant at a concentration equal to or greater than the critical micelle concentration (CMC), adding thereto a polymerizable monomer for producing the styrene acrylate resin, i.e. the amorphous resin, and adding an aqueous polymerization initiator at a desired polymerization temperature while stirring so as to polymerize the monomer.

Alternatively, when the amorphous resin is a styrene acrylate resin, the amorphous resin fine particle dispersion can be prepared by adding a monomer solution, in which a toner component such as the releasing agent and the charge controlling agent is dissolved or dispersed in a polymerizable monomer for producing the styrene acrylate resin, i.e. the amorphous resin, according to need, to an aqueous medium containing a surfactant at a concentration equal to or less than the critical micelle concentration (CMC), applying mechanical energy to form liquid particles, and then adding an aqueous radical polymerization initiator to cause a polymerization reaction in the liquid particles. The liquid particles may contain an oil-soluble polymerization initiator. In this amorphous resin fine particle dispersion preparing step, it is essential to apply mechanical energy to forcibly cause emulsification (formation of the liquid particles). To apply mechanical energy, means for applying intensive agitation or ultrasonic vibration energy such as a homomixer, an ultrasonic and a Manton-Gaulin homogenizer may be used.

The amorphous resin fine particle dispersion preparing step may be to form amorphous resin fine particles that are composed of two or more resin layers with different compositions. In this case, the step may involve preparing a dispersion of the first resin particles by an ordinary emulsion polymerization (first polymerization), and adding a polymerization initiator and a polymerizable monomer to the dispersion so as to polymerize the monomer in the system (second polymerization).

When a surfactant is used in this step, for example, the above-described surfactants may be used.

Polymerization Initiator

A variety of polymerization initiators known in the art can be used as the polymerization initiator. Specifically, such polymerization initiators include, for example, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxydicarbonate, tetralin hydroperoxide, 1-phenyl-2-methylpropyl-1-hydroperoxide, tert-hydroxyperoxide triphenylperacetate, tert-butyl performate, tert-butyl peracetate, tert-butyl perbenzoate, tert-butyl phenylperacetate, tert-butyl methoxyperacetate and tert-butyl N-(3-toluyl)perpalmitate; azo compounds such as 2,2'-azobis(2-amidinopropane) hydrochloride, 2,2'-azobis-(2-amidinopropane) nitrate, 1,1'-azobis(sodium 1-methylbutyronitrile-3-sulfonate), 4,4'-azobis-4-cyanovaleric acid and poly(tetraethylene glycol-2,2'-azobisisobutyrate); and the like. Among them, aqueous polymerization initiators such as ammonium persulfate, sodium persulfate, potassium persulfate, hydrogen peroxide, 2,2'-azobis(2-amidinopropane) hydrochloride, 2,2'-azobis-(2-amidinopropane) nitrate, 1,1'-azobis(sodium 1-methylbutyronitrile-3-sulfonate) and 4,4'-azobis-4-cyanovaleric acid are preferably used. Also, redox polymerization initiators such as a combination of a persulfate with a metabisulfite and a combination of hydrogen peroxide with ascorbic acid may also be used as the polymerization initiator.

Chain Transfer Agent

In the amorphous resin fine particle dispersion preparing step, a generally-used chain transfer agent may be used for the purpose of adjusting the molecular weight of the amorphous resin. The chain transfer agent may be any agent, for example, including alkylmercaptan, mercapto fatty acid esters and the like.

It is preferred that the amorphous resin fine particles obtained in the amorphous resin fine particle dispersion preparing step have an average particle size within the range of, for example, 50 nm to 500 nm in volume median size.

The volume median particle size is measured by an "UPA-150" (Microtrac Corp.).

(4) Aggregating and Fusing Step

This step is to aggregate and fuse the coloring agent fine particles, the amorphous resin fine particles and the crystalline polyester resin fine particles formed in the above-described steps in an aqueous medium. This step involves adding the amorphous resin fine particle dispersion, the crystalline polyester resin fine particle dispersion and the coloring agent fine particle dispersion to an aqueous medium and aggregating and fusing their fine particles.

Specifically, an example method for aggregating and fusing the coloring agent fine particles, the amorphous resin fine particles and the crystalline polyester resin fine particles involves adding a coagulant to the aqueous medium to a concentration equal to or greater than the critical aggregation concentration, and then heating the dispersion at a temperature that is equal to or greater than both of the glass transition point of the amorphous resin fine particles and the melting peak temperature of the releasing agent and the crystalline polyester resin, so as to cause salting out and fusion of the fine particles including the coloring agent fine particles, the amorphous resin fine particles and the crystalline polyester resin fine particles at the same time, adding an aggregation terminator when the particles are grown to a desired particle size, so as to terminate the growth of the particles, and if necessary, further heating the dispersion continuously in order to control the particle shape.

In this method, it is preferred that after the coagulant is added, the dispersion is heated to a temperature equal to or greater than the glass transition point of the amorphous resin fine particles of the binder resin as soon as possible. The reason thereof is not clear, but problems may occur depending on the length of the time after the salting out and before the heating, such as change of the aggregated state of the particles that deteriorates the stability of the particle size distribution, and change of the surface properties of the fused particles. Typically, the time before the heating is preferably equal to or less than 30 minutes, more preferably equal to or less than 10 minutes. Further, the heating rate is preferably equal to or greater than 1° C./min. The upper limit of the heating rate is not particularly specified. However, the heating rate is preferably equal to or less than 15° C./min in terms of preventing coarse particles due to rapid fusion. Further, it is important that after the temperature of the reaction system reaches a temperature equal to or greater than the glass transition point, the temperature of the system is held at the same temperature for a certain period of time so as to allow the fusion to continue. This allows the growth and the fusion of the toner particles to proceed effectively, which can improve the durability of the resultant toner particles.

Coagulant

The coagulant used may be any coagulant but is preferably selected from metal salts. Such metal salts include, for example, monovalent metal salts such as salts of alkali metals such as sodium, potassium and lithium; divalent metal salts such as salts of calcium, magnesium, manganese and copper; trivalent metal salts such as salts of iron and aluminum; and the like. Specific examples of such metal salts include sodium chloride, potassium chloride, lithium chloride, calcium chloride, magnesium chloride, zinc chloride, copper sulfate, magnesium sulfate, manganese sulfate and the like. Among them, divalent metal salts are particularly preferred since the aggregation is caused by a smaller amount. These coagulants may be used alone or in combination.

When a surfactant is used in this step, for example, the above-described surfactants may be used.

(5) Aging Step

Specifically, this step is to heat and stir the system containing the aggregated particles to form the toner particles with a desired shape, in which the heating temperature, stirring speed and heating time are controlled so that the average circularity of the aggregated particles reaches a desired level. In this step, it is preferred that the shape of the toner particles is controlled by heat energy (heating).

(6) Cooling Step to (8) Drying Step

For the cooling step, the filtering and washing step and the drying step, a variety of methods known in the art may be employed.

(9) External Additive Adding Step

The external additive adding step is to add and mix an external additive to the dried toner particles according to need.

An example method for adding the external additive is a dry method in which a powder external additive is added and mixed to the dried toner particles. For the mixing, a mechanical mixing machine such as a Henschel mixer and a coffee mill may be used.

Developer

The toner of the present invention may be used as a magnetic or nonmagnetic monocomponent developer or may be mixed with a carrier and used as a two component developer.

For the carrier, magnetic particles known in the art may be used, for example, including metals such as ferrite and magnetite, alloys of these metals with another metal such as aluminum and lead, and the like. Among them, ferrite particles are preferably used. Also, coated carriers, in which the surface of magnetic particles is covered with a coating agent such as resin, and resin dispersed carriers, in which magnetic fine particles are dispersed in a binder resin, may also be used for the carrier.

It is preferred that the carrier has a volume average particle size of 15 μm to 100 μm, more preferably 25 μm to 80 μm.

Image Forming Apparatus

The toner of the present invention can be used in a typical electrophotographic image forming method. An example of image forming apparatuses by this image forming method includes a photoreceptor which is for example an electrostatic latent image carrier, a charging unit to apply uniform potential to the surface of the photoreceptor by corona discharge with the same polarity as the toner, an exposing unit to expose the uniformly charged surface of the photoreceptor based on an image data to form an electrostatic latent image, a developing unit to bring the toner to the surface of the photoreceptor to develop the electrostatic latent image to form a toner image, a transferring unit to transfer the toner image to a transfer material, if necessary, via an intermediate transfer body, and a fixing unit to heat and fix the toner image on the transfer material.

Further, the toner of the present invention can be suitably used for image forming apparatuses that operate at a fixing temperature (surface temperature of the fixing member) within the range of 130° C. to 200° C.

Further, the toner of the present invention can be suitably used for relatively fast image forming apparatuses that operate at a fixing speed (paper conveying speed) of 300 mm/sec to 700 mm/sec.

While an embodiment of the present invention is specifically described, the embodiments of the present invention are not limited to the above-described examples, and various changes can be made.

EXAMPLES

Hereinafter, specific examples of the present invention will be described, but the present invention is not limited thereto.

Synthesis Example of Crystalline Polyester Resin (a)

Into a reaction vessel equipped with a stirrer, a nitrogen introducing tube, a temperature sensor and a rectifier, the polycarboxylic acid and dodecanedioic acid, 200 parts by mass the polyhydric alcohol 1,6-hexanediol, 140 parts by mass were charged. The temperature of the reaction system was raised to 190° C. over 1 hour. After checking that the reaction system is uniformly stirred, $Ti(OBu)_4$ was added as a catalyst in an amount of 0.006 mass % with respect to the total amount of polycarboxylic acid. Then, the temperature of the reaction system was further raised to 240° C. over 6 hours while distilling away produced water, and the temperature was held at 240° C. to allow the dehydration condensation reaction to further continue for 6 hours, so as to carry out polymerization. Thereafter, the reaction system was cooled to 160° C., and a mixture of acrylic acid, 5 parts by mass styrene, 75 parts by mass, butyl acrylate, 26 parts by mass, and a polymerization initiator (di-t-butyl peroxide), 16 parts by mass was added dropwise by using a dropping funnel over 1 hour. Thereafter, the temperature was held at 160° C. to allow the addition polymerization reaction to continue for 1 hour, and then the temperature was raised to 200° C. and was held for 1 hour at 10 kPa. Styrene and butyl acrylate were removed to yield crystalline polyester resin (a).

The resultant crystalline polyester resin (a) had a number average molecular weight (Mn) of 3400, a melting point of 67.1° C. and a ΔH of 69.0 J/g. The molecular weight, melting point and ΔH of the crystalline polyester resin (a) were measured as described above.

Preparation Example of Crystalline Polyester Resin Fine Particle Aqueous Dispersion (a)

The crystalline polyester resin (a) (30 parts by mass) was melted, and the melted resin was fed to an emulsion disperser "CAVITRON CD1010" (Eurotec Co., Ltd.) at a feeding rate of 100 parts by mass per minute while keeping the melted state. Simultaneously with feeding the melted crystalline polyester resin (a), diluted ammonia water at a concentration of 0.37 mass %, which was prepared by diluting 70 parts by mass of ammonia water regent with ion-exchanged water in an aqueous solvent tank, was fed to the emulsion disperser at a feeding rate of 0.1 L/min while heating it at 100° C. by a heat exchanger. The emulsion disperser was operated in the conditions of a rotation speed of the rotator of 60 Hz and a pressure of 5 kg/cm$^2$. A crystalline polyester resin fine particle aqueous dispersion (a) with a volume median particle size of 200 nm and a solid fraction of 30 parts by mass was thus prepared.

Synthesis Examples of Crystalline Polyester Resins (b) to (g)

Crystalline polyester resins (b) to (g) were obtained in the same manner as the synthesis example of the crystalline polyester resin (a) except that the diols and dicarboxylic acids listed in Table 1 were used respectively.

TABLE 1

| CRYSTALLINE POLYESTER | RESIN COMPOSITION | | | | PHYSICAL PROPERTIES | | |
|---|---|---|---|---|---|---|---|
| | POLYHYDRIC ALCOHOL | | POLYCARBOXYLIC ACID | | ΔH | MELTING POINT | |
| RESIN NO. | $C_{alcohol}$ | COMPOUND | $C_{add}$ | COMPOUND | (J/g) | (° C.) | Mn |
| a | 6 | 1,6-HEXANEDIOL | 12 | DODECANEDIOIC ACID | 69.0 | 67.1 | 3400 |
| b | 4 | 1,4-BUTANEDIOL | 12 | DODECANEDIOIC ACID | 65.0 | 72.0 | 4000 |
| c | 10 | 1,10-DECANEDIOL | 12 | DODECANEDIOIC ACID | 80.0 | 78.6 | 4100 |

TABLE 1-continued

| CRYSTALLINE POLYESTER | RESIN COMPOSITION | | | | PHYSICAL PROPERTIES | | |
|---|---|---|---|---|---|---|---|
| | POLYHYDRIC ALCOHOL | | POLYCARBOXYLIC ACID | | ΔH | MELTING POINT | |
| RESIN NO. | $C_{alcohol}$ | COMPOUND | $C_{add}$ | COMPOUND | (J/g) | (° C.) | Mn |
| d | 12 | 1,12-DODECANEDIOL | 6 | HEXANEDIOIC ACID | 82.5 | 70.2 | 3800 |
| e | 9 | 1,9-NONANEDIOL | 12 | DODECANEDIOIC ACID | 72.4 | 65.1 | 3500 |
| f | 6 | 1,6-HEXANEDIOL | 10 | SEBACIC ACID | 69.6 | 62.2 | 4400 |
| g | 12 | 1,12-DODECANEDIOL | 12 | DODECANEDIOIC ACID | 69.0 | 82.1 | 3300 |

Preparation Examples of Crystalline Polyester Resin Fine Particle Aqueous Dispersions (b) to (g)

Crystalline polyester resin fine particle aqueous dispersions (b) to (g) were prepared in the same manner as the preparation example of the crystalline polyester resin fine particle aqueous dispersion (a) except that the crystalline polyester resins (b) to (g) were used instead of crystalline polyester resin (a).

Preparation Example of Amorphous Resin Fine Particle Aqueous Dispersion (X)

First Polymerization

Into a 5 L reaction vessel equipped with a stirrer, a temperature sensor, a cooling tube and a nitrogen introducing device, 8 g of sodium dodecyl sulfate and 3 L of ion-exchanged water were charged. While stirring at a stirring speed of 230 rpm under nitrogen flow, the inner temperature was raised to 80° C. After the temperature was raised, 10 g of potassium persulfate dissolved in 200 g of ion-exchanged water was added thereto, and the liquid temperature was raised to 80° C. again. A monomer mixture composed of styrene, 480 g,
n-butyl acrylate, 250 g and
methacrylic acid, 68.0 g was added thereto dropwise over 1 hour. Then, the reaction system was heated and stirred at 80° C. for 2 hours to carry out the polymerization. A resin fine particle dispersion (x1) was thus prepared.

Second Polymerization

Into a 5 L reaction vessel equipped with a stirrer, a temperature sensor, a cooling tube and a nitrogen introducing device, a solution of 7 g of polyoxyethylene (2)sodium dodecylether sulfate dissolved in 800 ml of ion-exchanged water was charged. After heating to 98° C., 260 g of the resin fine particle dispersion (x1) and a solution composed of styrene (St), 284 g,
n-butyl acrylate (BA), 92 g,
methacrylic acid (MAA), 13 g,
n-octyl-3-mercaptopropionate, 1.5 g and
a releasing agent: behenic behenate (melting point of 73° C.), 190 g, which was prepared by dissolving the monomers and the releasing agent at 90° C., was added thereto. The reaction system was mixed and dispersed for 1 hour by using a mechanical disperser with a circulation route "CLEARMIX" (M Technique Co., Ltd.) so that a dispersion containing emulsion particles (oil particles) was prepared.

Then, an initiator solution of 6 g of potassium persulfate dissolved in 200 ml of ion-exchanged water was added to the dispersion, and the system was heated and stirred at 84° C. for 1 hour. A resin fine particle dispersion (x2) was thus prepared.

Third Polymerization

A solution of 11 g of potassium persulfate dissolved in 400 ml of ion-exchanged water was further added to the resin fine particle dispersion (x2). A monomer mixture composed of styrene (St), 400 g,
n-butyl acrylate (BA), 128 g,
methacrylic acid (MAA), 28 g,
methyl methacrylate (MMA), 45 g, and
n-octyl-3-mercaptopropionate, 8 g was added dropwise thereto at a temperature of 82° C. over 1 hour. After the addition, the system was heated and stirred for 2 hours to carry out the polymerization, and was then cooled to 28° C. An amorphous resin fine particle aqueous dispersion (X) of a vinyl resin was thus prepared.

The resultant amorphous resin particles of the amorphous resin fine particle aqueous dispersion (X) had a volume median particle size of 220 nm, a glass transition point (Tg) of 55° C. and a weight average molecular weight (Mw) of 32000.

Preparation Example of Amorphous Resin Fine Particle Aqueous Dispersion (Y)

An amorphous resin fine particle aqueous dispersion (Y) was prepared in the same manner as the preparation example of the amorphous resin fine particle aqueous dispersion (X) except that the composition of the monomer mixture used in the third polymerization was changed to styrene (St), 390 g,
n-butyl acrylate (BA), 126 g,
methacrylic acid (MAA), 50 g,
methyl methacrylate (MMA), 45 g, and
n-octyl-3-mercaptopropionate, 8 g.

Preparation Example of Amorphous Resin Fine Particle Aqueous Dispersion (Z)

An amorphous resin fine particle aqueous dispersion (Z) was prepared in the same manner as the preparation example of the amorphous resin fine particle aqueous dispersion (X) except that the composition of the monomer mixture used in the third polymerization was changed to styrene (St), 414 g,
n-butyl acrylate (BA), 130 g,
methacrylic acid (MAA), 12 g,
methyl methacrylate (MMA), 45 g, and
n-octyl-3-mercaptopropionate, 8 g.

Synthesis Example of Amorphous Polyester Resin (V)

Into a reaction vessel equipped with a stirrer, a nitrogen introducing tube, a temperature sensor and a rectifier, the polycarboxylic acid and
fumaric acid, 4.2 parts by mass
terephthalic acid, 78 parts by mass
the polyhydric alcohol
an adduct of 2,2-bis(4-hydroxyphenyl)propane with 2 mol of propyleneoxide, 152 parts by mass
an adduct of 2,2-bis(4-hydroxyphenyl)propane with 2 mol of ethyleneoxide, 48 parts by mass were charged. The temperature of the reaction system was raised to 190° C. over 1 hour. After checking that the reaction system was uniformly stirred, $Ti(OBu)_4$ was added as the catalyst in an amount of 0.006 mass % with respect to the total amount of the polycarboxylic acid. The temperature of the reaction system was further raised to 240° C. over 6 hours while distilling away produced water, and the temperature was held at 240° C. to allow the dehydrogenation condensation to continue for 6 hours. The polymerization was thus carried out to yield an amorphous polyester resin (V).

The resultant amorphous polyester resin (V) had a number average molecular weight (Mn) of 3300 and a glass transition point (Tg) of 55° C.

Preparation Example of Amorphous Polyester Resin Fine Particle Aqueous Dispersion (V)

The amorphous polyester resin (V) (30 parts by mass) was melted, and the melted resin was fed to an emulsion disperser "CAVITRON CD1010" (Eurotec Co., Ltd.) at a feeding rate of 100 parts by mass per minute while keeping the melted state. Simultaneously with feeding the melted amorphous polyester resin (V), diluted ammonia water at a concentration of 0.37 mass %, which was prepared by diluting 70 parts by mass of ammonia water regent with ion-exchanged water in an aqueous solvent tank, was fed to the emulsion disperser at a feeding rate of 0.1 L/min while heating it at 100° C. by a heat exchanger. The emulsion disperser was operated in the conditions of a rotation speed of the rotator of 60 Hz and a pressure of 5 kg/cm$^2$. An amorphous polyester resin fine particle aqueous dispersion (V) with a volume median particle size of 200 nm and a solid fraction of 30 parts by mass was thus prepared.

Preparation Example of Shell Resin Fine Particle Aqueous Dispersion (S)

(1) Synthesis of Polyester Resin

Into a reaction tank equipped with a cooling tube, a stirrer and a nitrogen introducing tube, 316 parts by mass of an adduct of bisphenol A with 2 mol of propylene oxide, 80 parts by mass of terephthalic acid, 34 parts by mass of maleic acid anhydride and 2 parts by mass of titanium tetraisopropoxide as a polycondensation catalyst were added in 10 additions. The reaction was allowed to proceed at 200° C. under nitrogen flow for 10 hours while distilling away produced water. Then, the reaction was allowed to proceed at a reduced pressure of 13.3 kPa (100 mmHg). When the softening point reached 104° C., the product was collected. The collected product was referred to as a polyester resin (s). The polyester resin (s) had a glass transition point (Tg) of 65° C., a number average molecular weight (Mn) of 4500 and a weight average molecular weight (Mw) of 13500.

(2) Synthesis of Styrene Acrylate Graft-Modified Polyester Resin

Into a reaction autoclave equipped with a thermometer and a stirrer, 430 parts by mass of xylene, 430 parts by mass of polyester resin (s) were charged and dissolved. After purged with nitrogen, a mixture solution of 18.1 parts by mass of styrene, 4.5 parts by mass of 2-ethylhexyl acrylate, 0.16 parts by mass of di-t-butylperoxide and 100 parts by mass of xylene was added dropwise at 170° C. over 3 hours to carry out the polymerization, and then the temperature was further held for 30 minutes. The product was desolvated to yield a styrene acrylate graft-modified polyester resin (S), which is the shell resin.

(3) Preparation of Shell Resin Fine Particle Aqueous Dispersion

The resultant styrene acrylate graft-modified polyester resin (S) (100 parts by mass) was dissolved in 400 parts by mass of ethyl acetate (Kanto Kagaku Corp.), and the solution was mixed with 638 parts by mass of 0.26 mass % sodium lauryl sulfate solution, which was prepared beforehand. While stirring, the mixture was dispersed by ultrasonication for 30 minutes by using an ultrasonic homogenizer "US-150T" (Nissei Corp.) in the condition of a V-LEVEL of 300 μA. Thereafter, the mixture was stirred and heated at 40° C. under reduced pressure for 3 hours by using a diaphragm vacuum pump "V-700" (BÜCHI Labortechnik AG) to completely remove ethyl acetate. A shell resin fine particle aqueous dispersion (S) having an average particle size (volume median particle size) of 160 nm and a solid fraction of 13.5 mass % was thus prepared.

Preparation Example of Coloring Agent Fine Particle Aqueous Dispersion (Bk)

Sodium dodecyl sulfate (90 parts by mass) was added to 1600 parts by mass of ion-exchanged water. While stirring the solution, 420 parts by mass of carbon black "REGAL 330R" (Cabot Corp.) was gradually added thereto. Then, the mixture was subjected to a dispersing treatment using a disperser "CLEARMIX" (M Technique Co., Ltd.). A coloring agent fine particle aqueous dispersion (Bk) was thus prepared.

The resultant coloring agent fine particle aqueous dispersion (Bk) had an average particle size (volume median particle size) of the coloring agent fine particles of 110 nm.

Example 1

Toner Production Example 1

Into a reaction vessel equipped with a stirrer, a temperature sensor and a cooling tube, 288 parts by mass (in solid fraction) of the amorphous resin fine particle aqueous dispersion (X), 70 parts by mass (in solid fraction) of the crystalline polyester resin fine particle aqueous dispersion (a) and 2000 parts by mass of ion-exchanged water were charged. Thereafter, the pH was adjusted to 10 by adding 5 mol/L sodium hydroxide aqueous solution.

Thereafter, 40 parts by mass (in solid fraction) of the coloring agent fine particle aqueous dispersion (Bk) was added thereto. Then while stirring, an aqueous solution of 60 parts by mass of magnesium chloride dissolved in 60 parts by mass of ion-exchanged water was added at 30° C. over 10 minutes. After 3 minutes, the temperature of the system was raised to 80° C. over 60 minutes, and the temperature was held at 80° C. to allow the particle growth reaction to continue. While keeping this condition, the particle size of the aggregated particles was measured by using a "Coulter Multisizer 3" (Beckman Coulter, Inc.). When the volume median particle size reached 6.0 μm, 72 parts by mass (in solid fraction) of the shell resin fine particles aqueous dispersion (S) was added over 30 minutes. When the supernatant of the reaction solution became clear, an aqueous solution of 190 parts by mass of sodium chloride dissolved in 760 parts by mass of ion-exchanged water was added to terminate the particle growth. Then, the reaction system was further heated and stirred at 90° C. to allow fusion of the particles to proceed. When the average circularity of the toner measured by a measuring equipment "FPIA-2100" (Sysmex Corp.) (HPF detect number of 4000) reached 0.945, the reaction system was cooled to 30° C.

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield black toner particles (1×).

To 100 parts by mass of the resultant toner particles (1×), 0.6 parts by mass of hydrophobic silica (number average primary particle size=12 nm, hydrophobicity=68) and 1.0 part by mass of hydrophobic titanium oxide (number average primary particle size=20 nm, hydrophobicity=63) were added, and the mixture was mixed at 32° C. for 20 minutes by using a "Henschel mixer" (Mitsui Miike Machinery Co., Ltd.) in the condition of a rotary blade circumferential speed of 35 mm/sec. Thereafter, coarse particles were removed by using a sieve with an opening size of 45 μm, and the external additive was added. Toner particles (1) were thus prepared.

Example 2 to Example 9, Comparison 1 and Comparison 2: Toner Production Examples 2 to 9, 11 and 12

Toners (2) to (9), (11) and (12) were obtained in the same manner as the toner production example 1 except that the aqueous dispersions listed in Table 2 were respectively used instead of the amorphous resin fine particle aqueous dispersion (X) and the crystalline polyester resin fine particle aqueous dispersion (a).

Example 10

Toner Production Example 10

A toner (10) was obtained in the same manner as the toner production example 1 except that the amorphous polyester resin fine particle aqueous dispersion (V), 245 parts by mass (in solid fraction), and a releasing agent fine particle aqueous dispersion (1) described below, 43 parts by mass (in solid fraction) were added instead of 288 parts by mass (in solid fraction) of the amorphous resin fine particle aqueous dispersion (X).

Preparation Example of Releasing Agent Fine Particle Aqueous Dispersion (1)

A mixture solution composed of behenic behenate (melting point of 73° C.), 60 parts by mass, an ionic surfactant (NEOGEN RK, Daiichi Kogyo Seiyaku Co., Ltd.), 5 parts by mass and ion-exchanged water, 240 parts by mass was heated to 95° C. and dispersed well by using an "ULTRA-TURRAX T50" (IKA-Werke GmbH & Co. Kg). Thereafter, the solution was further dispersed by using a pressure Gorlin homogenizer to yield a releasing agent fine particle aqueous dispersion (1) having a solid fraction of 20 mass % and a volume average particle size of the dispersed releasing agent fine particles of 240 nm.

Comparison 3: Toner Production Example 13

A toner (13) was obtained in the same manner as the toner production example 10 except that the crystalline polyester resin fine particles aqueous dispersion (e) was used instead of the crystalline polyester resin fine particle aqueous dispersion (a).

Carrier Production Example

Manganese-magnesium ferrite particles with a weight average particle size of 50 μm were coated by a coating agent that contains 85 parts by mass (in solid fraction) of a silicone resin (cured by oxime, in toluene solution), 10 parts by mass of γ-aminopropyltrimethoxysilane (coupling agent), 3 parts by mass of alumina particles (particle size of 100 nm) and 2 parts by mass of carbon black by means of spray coating. The particles were baked at 190° C. for 6 hours and

TABLE 2

| | | AMORPHOUS RESIN FINE PARTICLE | CRYSTALLINE POLYESTER RESIN | | | | | | PHYSICAL PROPERTIES OF TONER | | | | |
|---|---|---|---|---|---|---|---|---|---|---|---|---|---|
| | TONER No. | AQUEOUS DISPERSION No. | No. | $C_{alcohol}$ | $C_{add}$ | ΔH (J/g) | INTRODUCED AMOUNT | MELTING POINT (° C.) | ΔH0 | ΔH1 | ΔH2 | ΔH1/ΔH0 | ΔH2/ΔH1 |
| EXAMPLE 1 | 1 | X | a | 6 | 12 | 69 | 15% | 67.1 | 10.4 | 5.9 | 3.5 | 57% | 59% |
| EXAMPLE 2 | 2 | X | b | 4 | 12 | 65 | 15% | 72 | 9.8 | 4.3 | 2.9 | 44% | 67% |
| EXAMPLE 3 | 3 | X | c | 10 | 12 | 80 | 15% | 78.6 | 12.0 | 10.8 | 9.8 | 90% | 91% |
| EXAMPLE 4 | 4 | Y | a | 6 | 12 | 69 | 15% | 67.1 | 10.4 | 5.1 | 3.2 | 49% | 63% |
| EXAMPLE 5 | 5 | Z | c | 10 | 12 | 80 | 15% | 78.6 | 12.0 | 10.9 | 10.0 | 91% | 92% |
| EXAMPLE 6 | 6 | X | a | 6 | 12 | 69 | 10% | 67.1 | 6.9 | 3.1 | 2.2 | 45% | 71% |
| EXAMPLE 7 | 7 | X | a | 6 | 12 | 69 | 20% | 67.1 | 13.8 | 9.9 | 7.8 | 72% | 79% |
| EXAMPLE 8 | 8 | X | d | 12 | 6 | 82.5 | 15% | 70.2 | 12.4 | 9.6 | 8.7 | 78% | 91% |
| EXAMPLE 9 | 9 | X | e | 9 | 12 | 72.4 | 15% | 65.1 | 10.9 | 8.9 | 7.6 | 82% | 85% |
| EXAMPLE 10 | 10 | V | a | 6 | 12 | 69 | 15% | 67.1 | 10.4 | 7.3 | 4.3 | 71% | 59% |
| COMPARISON 1 | 11 | X | f | 6 | 10 | 69.6 | 15% | 62.2 | 10.4 | 3.4 | 0.3 | 33% | 9% |
| COMPARISON 2 | 12 | X | g | 12 | 12 | 69 | 15% | 82.1 | 10.4 | 10.0 | 10.2 | 97% | 102% |
| COMPARISON 3 | 13 | V | e | 9 | 12 | 72.4 | 15% | 65.1 | 10.9 | 3.2 | 0.8 | 29% | 25% |

were thereafter allowed to cool to ordinary temperature to yield a resin-coated carrier. The average film thickness of the resin coating was 0.2 μm.

Developer Production Examples 1 to 13

The carrier thus produced (94 parts by mass) was mixed with 6 parts by mass of the above-described toners (1) to (13) by using a V mixer to produce respective developers (1) to (13). The mixing was terminated when the charge amount of the toner reached from 20 to 23 pC/g, and the produced developer was discharged to a polyethylene pot.

(1) Low Temperature Fixability

The developers (1) to (13) were subjected to a fixing test in which a black image having a toner amount of 11 mg/10 $cm^2$ is fixed on a transfer paper at a linear paper conveying speed of 500 mm/sec by using a modified "BIZHUB PRO C6500" (Konica Minolta, Inc.). The fixing test was repeated at elevated fixing temperatures from 100° C., 105° C. . . . to 210° C. at 5° C. intervals. The fixing test was conducted under a low-temperature low-humidity environment (temperature of 10° C., humidity of 10% RH).

Each of the printed matters obtained in the fixing test at different temperatures was folded by a folding machine, and air compressed at a pressure of 0.35 MPa is blown to the formed crease. According to a boundary sample, the condition of the crease was ranked into 5 grades as described in the following evaluation criteria. The fixing temperature at which a crease was ranked to Grade 3 was determined as the lower limit fixing temperature. The results are shown in Table 2. When the lower limit fixing temperature is equal to or less than 140° C., the developer is determined as acceptable.

Evaluation Criteria

Grade 5: No peel-off is found in the crease.

Grade 4: A partial peel-off is found along the crease.

Grade 3: A narrow linear peel-off is found along the crease.

Grade 2: A bold linear peel-off is found along the crease.

Grade 1: A large peel-off is found in the image.

(2) Heat-Resistant Storage Stability of Toner

For each of the toners (1) to (13), 0.5 g of the toner was weighed in a 10 mL glass bottle having an inner diameter of 21 mm, and the lid was closed. The bottle was shaken for 600 times at room temperature by using a shaker "Tap Denser KYT-2000" (Seishin Enterprise Co., Ltd.). The bottle was left for 2 hours with the lid off in an environment of a temperature of 55° C. and a humidity of 35% RH. Then, the toner was placed on a #48 sieve (opening size of 350 μm) with care so that toner aggregates are not crushed. The sieve was set to a "Powder Tester" (Hosokawa Micron Corp.) and fixed with a pressure bar and a knob nut. The vibration strength was adjusted to a width of 1 mm, and a vibration was applied for 10 seconds. Thereafter, the ratio (mass %) of the toner left on the sieve was measured, and the toner aggregation rate was calculated according to the following Equation (A). The heat-resistant storage stability of the toner particles was evaluated according to the measured toner aggregation rate. The results are shown in Table 2. A toner having a toner aggregation rate of 20% or less is determined as acceptable.

Toner aggregation rate (%)=(Mass (g) of toner left on sieve)/0.5 (g)×100 Equation (A):

TABLE 3

| | TONER No. | EVALUATION RESULT: LOW-TEMPERATURE FIXABILITY (LOWER LIMIT FIXING TEMPERATURE (° C.)) | EVALUATION RESULT: HEAT-RESISTANT STORAGE STABILITY (MASS %) |
|---|---|---|---|
| EXAMPLE 1 | 1 | 120 | 12 |
| EXAMPLE 2 | 2 | 105 | 18 |
| EXAMPLE 3 | 3 | 140 | 7 |
| EXAMPLE 4 | 4 | 125 | 16 |
| EXAMPLE 5 | 5 | 135 | 5 |
| EXAMPLE 6 | 6 | 125 | 7 |
| EXAMPLE 7 | 7 | 120 | 15 |
| EXAMPLE 8 | 8 | 135 | 6 |
| EXAMPLE 9 | 9 | 140 | 10 |
| EXAMPLE 10 | 10 | 135 | 10 |
| COMPARISON 1 | 11 | 100 | 65 |
| COMPARISON 2 | 12 | 150 | 7 |
| COMPARISON 3 | 13 | 110 | 27 |

This U.S. patent application claims priority to Japanese patent application No. 2014-213488 filed on Oct. 20, 2014, the entire contents of which are incorporated by reference herein for correction of incorrect translation.

What is claimed is:

1. An electrostatic image developing toner comprising toner particles that contain coloring particles containing a binder resin, a coloring agent and a releasing agent, wherein the binder resin comprises an amorphous resin and a crystalline polyester resin, wherein the electrostatic image developing toner satisfies the following Relation (1) and Relation (2), $$0.43<\Delta H1/\Delta H0<0.95 \quad \text{Relation (1):}$$

$$0.45<\Delta H2/\Delta H1<1.20 \quad \text{Relation (2):}$$

where ΔH1 (J/q) is the amount of heat absorption based on a melting peak of the crystalline polyester resin in a first heating step from room temperature to 150° C., determined on a DSC curve of the electrostatic image developing toner measured by a differential scanning calorimetry, ΔH2 (J/g) is the amount of heat absorption based on a melting peak of the crystalline polyester resin in a second heating step from 0° C. to 150° C., determined on the DSC curve of the toner, and ΔH0 (J/g) is the value of the amount of heat absorption based on a melting peak of the crystalline polyester resin in the second heating step from 0° C. to 150° C., determined on a DSC curve of the crystalline polyester measured by a differential scanning calorimetry, multiplied by the ratio of the crystalline polyester introduced in the electrostatic image developing toner, and wherein the crystalline polyester resin satisfies the following Relation (7) and Relation (8), $$C_{acid}\geq 10 \quad \text{Relation (7):}$$

$$6\leq C_{alcohol}\leq 12 \quad \text{Relation (8):}$$

where $C_{alcohol}$ is the number of carbons of a main chain of a structural unit derived from a polyhydric alcohol for producing the crystalline polyester resin, and $C_{acid}$ is the number of carbons of a main chain of a structural unit derived from a polycarboxylic acid for producing the crystalline polyester resin.

2. The electrostatic image developing according to claim 1, wherein the electrostatic image developing toner satisfies the following Relation (3) and Relation (4)

$$0.48<\Delta H1/\Delta H0<0.90 \quad \text{Relation (3):}$$

$$0.50<\Delta H2/\Delta H1<0.95. \quad \text{Relation (4):}$$

3. The electrostatic image developing toner according to claim 1, wherein the crystalline polyester resin has a melting point of 65° C. to 85° C.

4. The electrostatic image developing toner according to claim 3, wherein the crystalline polyester resin has a melting point of 70° C. to 85° C.

5. The electrostatic image developing toner according to claim 1, wherein the electrostatic image developing toner satisfies the following Relation (9) and Relation (10)

$$0.55\leq\Delta H1/\Delta H0\leq0.85 \quad \text{Relation (9):}$$

$$0.55\leq\Delta H2/\Delta H1<0.80. \quad \text{Relation (10):}$$

6. The electrostatic image developing toner according to claim 1, wherein the toner particles has a core-shell structure in which a shell layer is provided on a surface of the coloring particles.

7. The electrostatic image developing toner according to claim 1, wherein the amorphous resin is a vinyl resin.

* * * * *